United States Patent [19]

Tsurubuchi

[11] Patent Number: 4,760,767

[45] Date of Patent: Aug. 2, 1988

[54] APPARATUS FOR DETECTING STRING STOP POSITION

[75] Inventor: Tooru Tsurubuchi, Osaka, Japan

[73] Assignee: Roland Corporation, Osaka, Japan

[21] Appl. No.: 895,640

[22] Filed: Aug. 12, 1986

[30] Foreign Application Priority Data

Aug. 27, 1985 [JP] Japan ..... 60-188963

[51] Int. Cl.[4] ..... G10H 3/00

[52] U.S. Cl. ..... 84/1.16; 84/DIG. 30

[58] Field of Search ..... 84/1.14–1.16, 84/DIG. 30; 336/115, 117–119, 124, 131

[56] References Cited

U.S. PATENT DOCUMENTS 4,425,511 1/1984 Brosh ..... 336/119 X
4,468,997 9/1984 Young, Jr. ..... 84/1.01
4,630,520 12/1986 Bonanno ..... 84/1.16
4,658,690 4/1987 Aitken et al. ..... 84/1.16 X

FOREIGN PATENT DOCUMENTS 59-176783 10/1984 Japan .

*Primary Examiner*—S. J. Witkowski
*Attorney, Agent, or Firm*—Armstrong, Nikaido, Marmelstein & Kubovcik

[57] ABSTRACT

In apparatus for detecting string stop position for string instruments, there is provided fret detecting means comprising coils which generate an induced voltage by means of an electric current flowing through each of the frets, whereby the string stop position may be detected on the basis of the induced voltage generated by the coil which corresponds to the fret contacting the string when the string is stopped.

4 Claims, 7 Drawing Sheets

CPU CONTROLLER
9
SIGNAL SELECT
RESET
S/H PUL
14
14a
14b
14c
14d
14e
A00
A01
C1
C2
A
A1
A2
A8
COM
INH
A B C
A9 ~ A16
A17 ~ A24
13
13a
13b
13c
12
20
21
22
S1 S2 S3 S4 S5 S6
F22 F23 F24

APPARATUS FOR DETECTING STRING STOP POSITION

BACKGROUND OF THE INVENTION

This invention relates to an apparatus for detecting a string stop position or positions, which apparatus detects position data of a string or strings stopped or pressed by a finger or fingers in string instruments such as a guitar having a tightened string or strings and a plurality of frets for determining a sound pitch.

Such an apparatus for detecting string stop positions is normally used where detected signals are output to a synthesizer so as to play with the corresponding musical scale. U.S. Pat. No. 4,468,997 or Japanese Application Serial No. 59-21524 is (Publication No. 59-176783) known as the prior art.

Recently, a MIDI standard has been established internationally by centering around keyed instruments and it has tried to extend the standard to the field of string instruments. However, in the case of the string instruments, there is a particular difficulty of how to detect played notes (pitch of name). Namely, in the case of the keyed instruments, a switch is arranged at each key so that the played note or notes may be detected by means of on-off operations of the switch. However, since such string instruments are not provided with keys normally, it is very difficult to detect the played notes in comparison with keyed instruments. Therefore, many kinds of means for detecting played notes have been proposed for string instruments. For example, there is an invention desclosed in Japanese Application Ser. No. 59-21524 (publication No. 59-176783). This invention may detect a string stop position by utilizing electric resistance of the string. In detail, when the string is stopped, the string contacts a pair of frets located on both of the sides of the stopped position thereof. When an electric current flows through the string, there occurs a difference in electric potential in accordance with the value of resistance of the string. Thus, the stopped position of the string may be detected by detecting the difference of the electric potential between the frets.

However, according to the above-mentioned conventional detecting means, there are problems as follows:

1. The strings, which are normally used for, for instance, an electric guitar, are made of steel and each of the electric resistances of the strings is $10\text{–}20\times10^{-8}$ Ωm. Therefore, the defference of the electric potential occurred in the string is considerably small and sometimes it is substantially equal to the level of noise.

2. To evade a mistake or wrong operation due to the small difference of the electric potential, it is necessary to increase the electric current flowing through the string so that the value of the electric potential to be detected may be much greater than that of the noise level.

However, it is impossible to flow such a great electric current in the conventional apparatus which utilizes an IC as electric current supply means for the strings.

SUMMARY OF THE INVENTION

In view of the above-mentioned circumstances,this invention has an object to provide a novel and useful means which may detect stopped position or positions of a string or strings without a mistake even though an IC is used as electric current supply means.

According to this invention, to achieve the above object, the apparatus for detecting at least one stop position in string instruments having at least one tightened string and a plurality of frets for determining a sound pitch, comprises electric current supply means for supplying an electric current to the string, and fret detecting means including coils, each coil being arranged correspondingly to each of the frets for generating an induced voltage by means of the electric current flowing through each of the frets, whereby the string and the frets are contacted to each other by a finger action so as to detect the stopped position of the string on the basis of the induced voltage generated by the coil corresponding to the fret.

Namely, since the fret detecting means is constructed of the coil, the electric current flowing through the fret is detected by the voltage generated by means of the coil when the string is stopped. Where the electric current flowing through the fret is represented by I, the induced voltage e is as follows:

$$e=-M(dI/dt)$$

wherein M represents mutual inductance.

Namely, the induced voltage e is proportional to variation of time of the electric current flowing through the frets.

Accordingly, this invention is quite different from the prior art which detects resistance of the string since the stopped position of the fret is detected on the basis of the voltage generated by the coil corresponding to each of the frets.

Moreover, this invention may detect the fret stop position precisely in the following cases.

As shown by a mark O in FIG. 10, suppose that a first string S1 is stopped at a tenth fret P1 and a second string S2 is stopped at a tenth fret P2 and an eleventh fret P3 as well. As to the second string, since a plurality of the frets are in contact with the string at P2 and P3, an induced voltage is generated by each of coils which are disposed correspondingly to the plural frets.

However, the highest induced voltage is generated by the coil which corresponds to the eleventh fret which becomes a nodal point of the string when an electric current is sent from the side of the bridge of the guitar.

Further, in the case of the first string, the electric current charged to the first string is charged also to the second string through the tenth fret and flows through the eleventh fret and a ninth fret. Therefore, in this case, through the induced voltage are generated by the coils corresponding to these frets, the highest induced voltage is generated by the coil corresponding to the tenth fret which becomes a nodal point of the string. This function is acknowledged by the inventor through experiment. Accordingly, in the case of the plural strings, the stopped position or positions of the fret or frets may be precisely detected by means of the coil which generates the highest induced voltage among the coils.

Other objects and advantages of this invention will be apparent from the following description.

BRIEF DESCRIPTION OF THE DRAWINGS

The drawings show an embodiment of this invention in which.

DESCRIPTION OF THE PREFERRED EMBODIMENT

Figure 1:
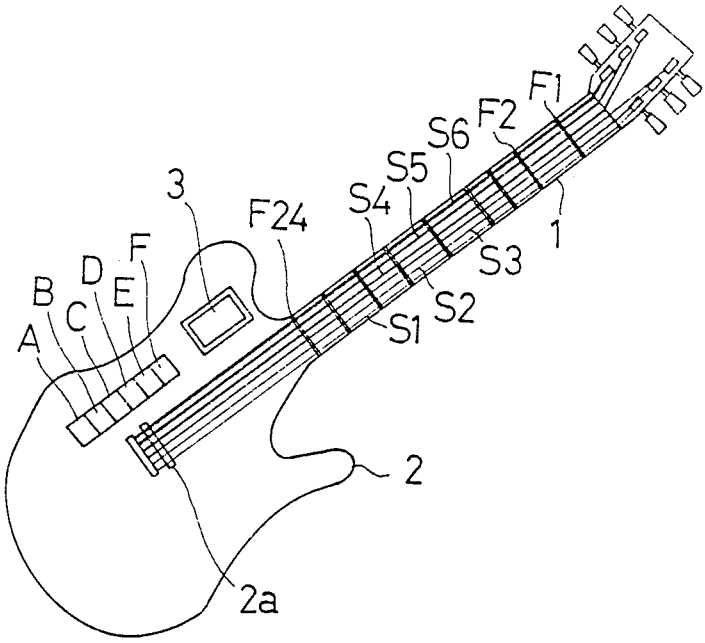
FIG. 1 is a front view of a guitar provided with the apparatus of this invention.

FIG. 1 shows a guitar as an example of string instruments which houses therein an apparatus of this invention. 1 denotes a neck and 2 is a body of the guitar. A number of frets F1, F2 . . . and F24 are mounted on the neck 1 and above the frets there are extended six strings S1–S6 from the body 2 to a tip end of the neck 1. Function switches A–F and a display device 3 are mounted on the body 2.

(Function Switches)

The function switches A–F are utilized for setting a tone quality (in other words, change of program) and channels of a MIDI. For instance, the function switch A is used for changing a program and when the first fret of the first string is stopped, in the state of turning on the switch A, the played tone is changed to a piano tone. Further, when the second fret is stopped, a tone setting signal is transmitted for changing the MIDI to produce a string tone. The apparatus for detecting string stop position of this invention may detect that the string is stopped at which fret.

The function switch B is for setting a channel of the MIDI and when the first fret is stopped, in the state of turning on the switch, the first channel is set. When the second fret is stopped, the second channel is set. Thus, the channels of the MIDI for transmitting for the guitar may be set in this embodiment.

Further, the function switch C is for setting a tuning of the string instrument. Tuning of each of the strings may be carried out in any manner in the case of a string instrument which operates a synthesizer by detecting a stopped fret, as in this invention. Namely, even if the strings are not precisely tuned, note data corresponding to the stopped fret, are transmitted from the apparatus and then a sound source receiving the data becomes to produce a sound with precise tune corresponding to the stopped fret. However, tuning of the strings may be varied sometimes. Normally, in the case of the guitar, the first string is tuned to be an E, the second string to be a B, the third string to be a G, the fourth string to be a D, the fifth string to be an A and the sixth string to be the E. However, the sixth string is tuned to be, for example, a D, sometimes. In this case, by stopping the tenth fret of the sixth string while the function switch C is turned on, the free portion of the sixth string becomes the D. Namely, in the event that the twelfth fret is stopped, it may easily change the tuning by stopping other frets. Since the operations of these function switches are not essential to this invention, the detailed description thereof is omitted herein.

(Devices Housed in the Guitar)

Figure 2:
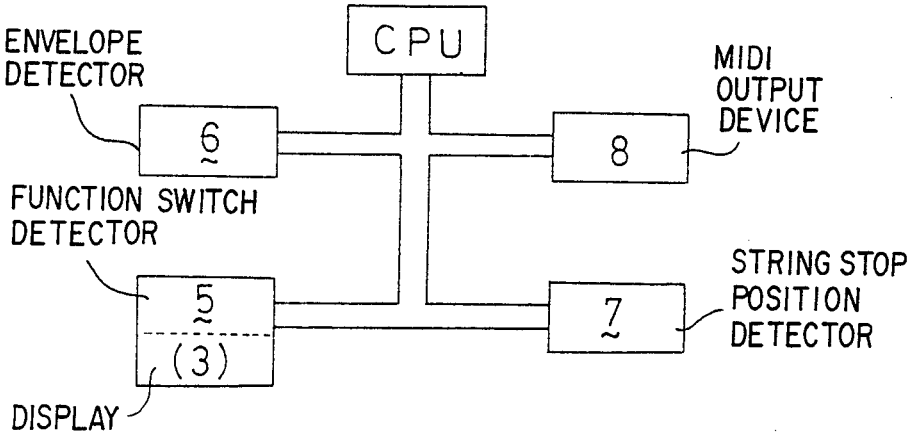
FIG. 2 is a block diagram showing an entire circuit of the apparatus assembled in the guitar.
Figure 3:
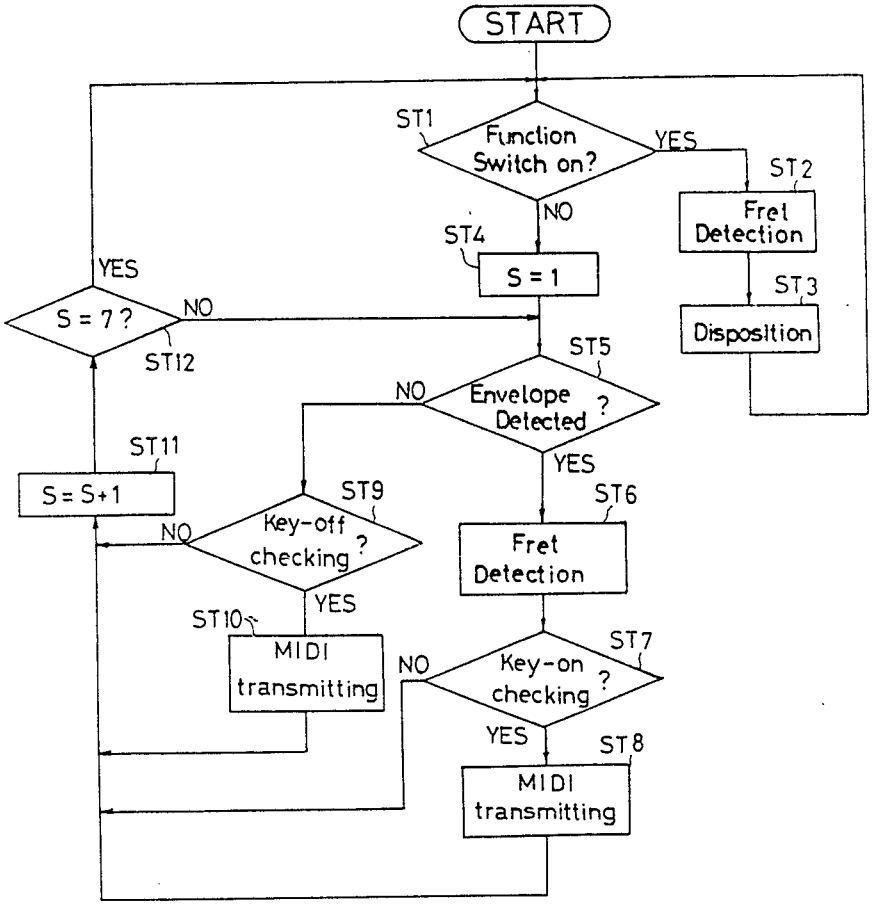
FIG. 3 is a flow chart for explaining the function of the block diagram in FIG. 2.

The guitar is provided with each of the devices which is shown by a block diagram in brief in FIG. 2, other than the apparatus for detecting string stop positions of this invention. In FIG. 2, 5 indicates a function switch detecting device and 6 is an envelope detecting device. 7 is the apparatus for detecting string stop positions of this invention. 8 indicates a MIDI output device and 9 is a control CPU. A deive section of a desplay 3 is included in the function detecting switch device 5. Each of the above-mentioned devices 5–8 carries out the functions as shown by the flow chart in FIG. 3, in accordance with the function of the control CPU 9. For example, an i 8051 of Intel Co. may be used as the control CPU 9.

First, it is judged by a step ST-1 as to whether or not the function switches A–F are turned on. When any of the function switches is turned on, it proceeds to a step ST-2 and then it is took place to detect the fret which contacts the string. This detection is performed by means of the apparatus 7 of this invention. After the detection of the fret is took place, it proceeds to a step ST-3 and then a signal of the MIDI is transmitted so as to carry out a necessary step such as display by a display 3.

On the other hand, when any of the function switches A–F is not turned on, it proceeds from the step ST-1 to a step ST-4 and a step ST-5 so as to carry out an envelope detection with respect to the first string. In the event that the level value of the envelope is higher than a certain value (This means vibration of the string.), then it proceeds to a step ST-6 so as to carry out detection of the fret. This detection of the fret is took place by means of the apparatus 7 of this invention. After completion of detection of the fret, checking is carried out as to the state of key-on. The key-on can be checked by comparing the measurement at this time with that of the last time to judge whether the envelope signal has been transmitted for the first time in the measurement at this time. In case that the result of the checking of key-on is yes (Namely, the envelope rises for the first time.), it proceeds to a step ST-8, the key-on signal of the pitch name indicated by the number of the fret is transmitted from the MIDI transmitting device. In case that the result of the checking of key-on is no, further transmitting of the key-on signal is not carried out since the key-on signal is transmitted at the last time of measurement. When the envelope signal is not detected in the step ST-5, it proceeds to a step ST-9 so as to make checking of key-off. The key-off can be checked by comparing the measurement at this time with that of the last time to judge whether no detection of the envelope signal is made for the first time in the measurement at this time. In case that the result of the checking of key-off is yes, it proceeds to a step ST-10, the key-off signal is transmitted from the MIDI transmitting device. In the event that the result of the checking of key-off is no, the key-off signal is no longer transmitted.

Figure 4:
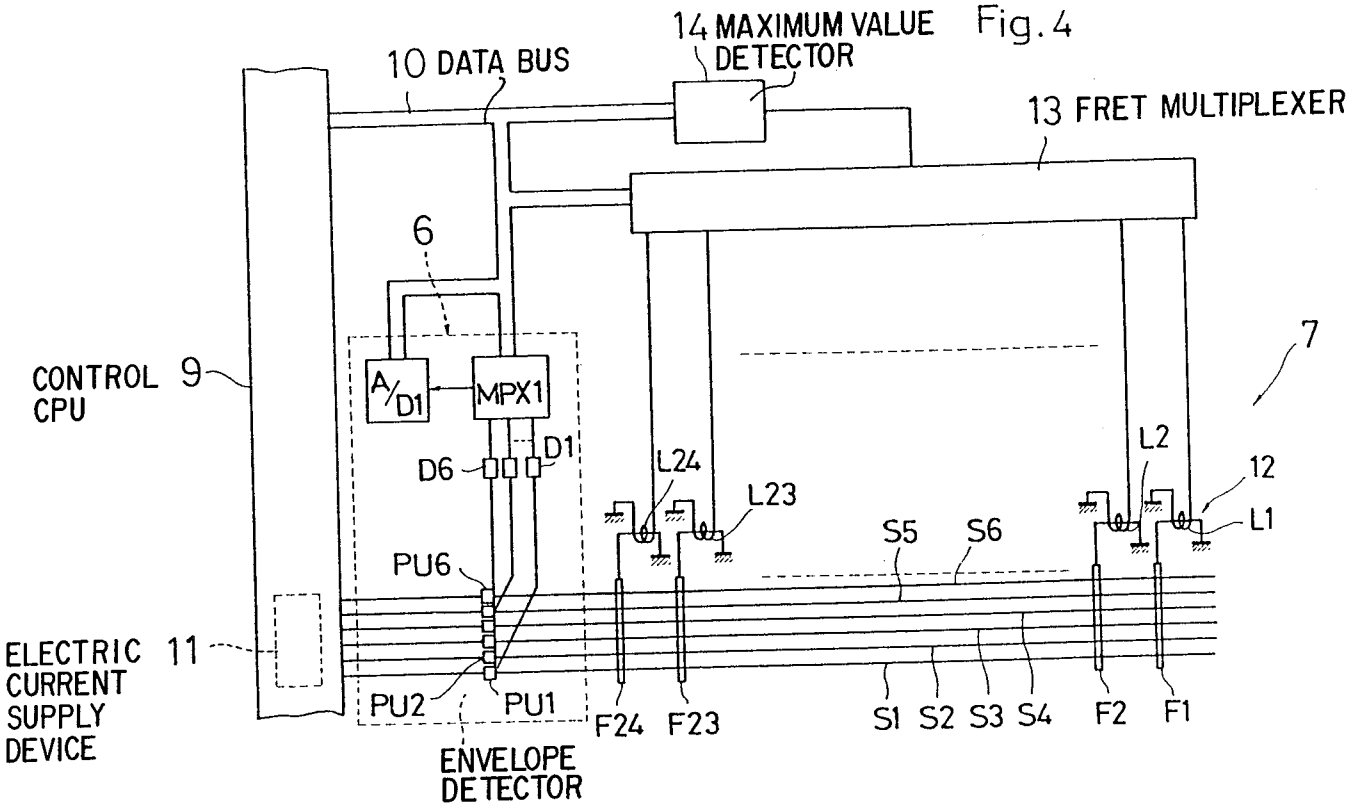
FIG. 4 is a block diagram showing the apparatus of this invention.

When the checking of key-on or key-off with respect to the first string is completed, it proceeds from a step ST-11 to the step ST-5 so as to increase the number S for indicating the string by one and then the checking of key-on or key-off with respect to the second string is carried out. After the same steps are completed with respect to the first string to the sixth string, the detecting operations are ended and it is returned to the first or initial state since the number S becomes 7 in a step ST-12. A block diagram of the envelope detecting device and the string stop position detecting apparatus are shown in FIG. 4. In the drawing, 6 denotes the envelope detecting device and 9 is the control CPU. 12 indicates a fret detecting device and 13 is fret multiplexer and 14 denotes a maximum value detecting circuit.

The envelope detecting device 6 comprises pickups PU1–PU6 for detecting vibration of each of the strings S1–S6, envelope detecting elements D1–D6 and an A/D converter for detecting an envelope of the detected output of each of the pickups, an A/D converter A/D1 and an envelope multiplexer MPX 1 for changeably connecting each of the envelope detecting devices D1–D6 and the A/D converter A/D1 at a predetermined timing. The envelope multiplexer MPX 1 receives a control signal from the control CPU through the data bus 10 and is then changed and scanned by the control signal. Accordingly, the envelopes of the strings S1–S6 detected by the envelope detecting devices D1–D6, are converted to digital values in order by the A/D converter A/D1 and then charged to the control CPU.

Figure 5:
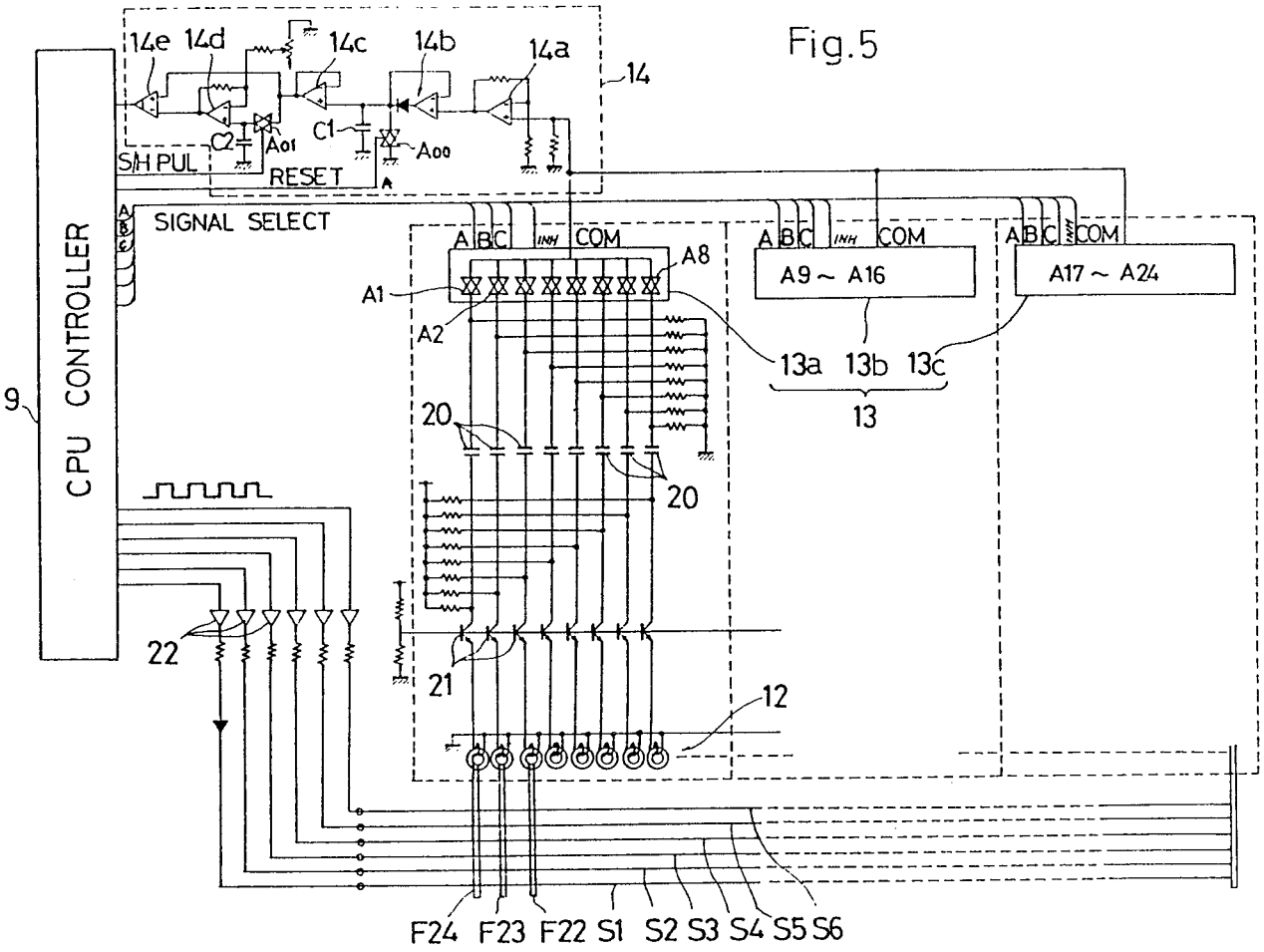
FIG. 5 is a detailed circuit of the apparatus of this invention.
Figure 6:
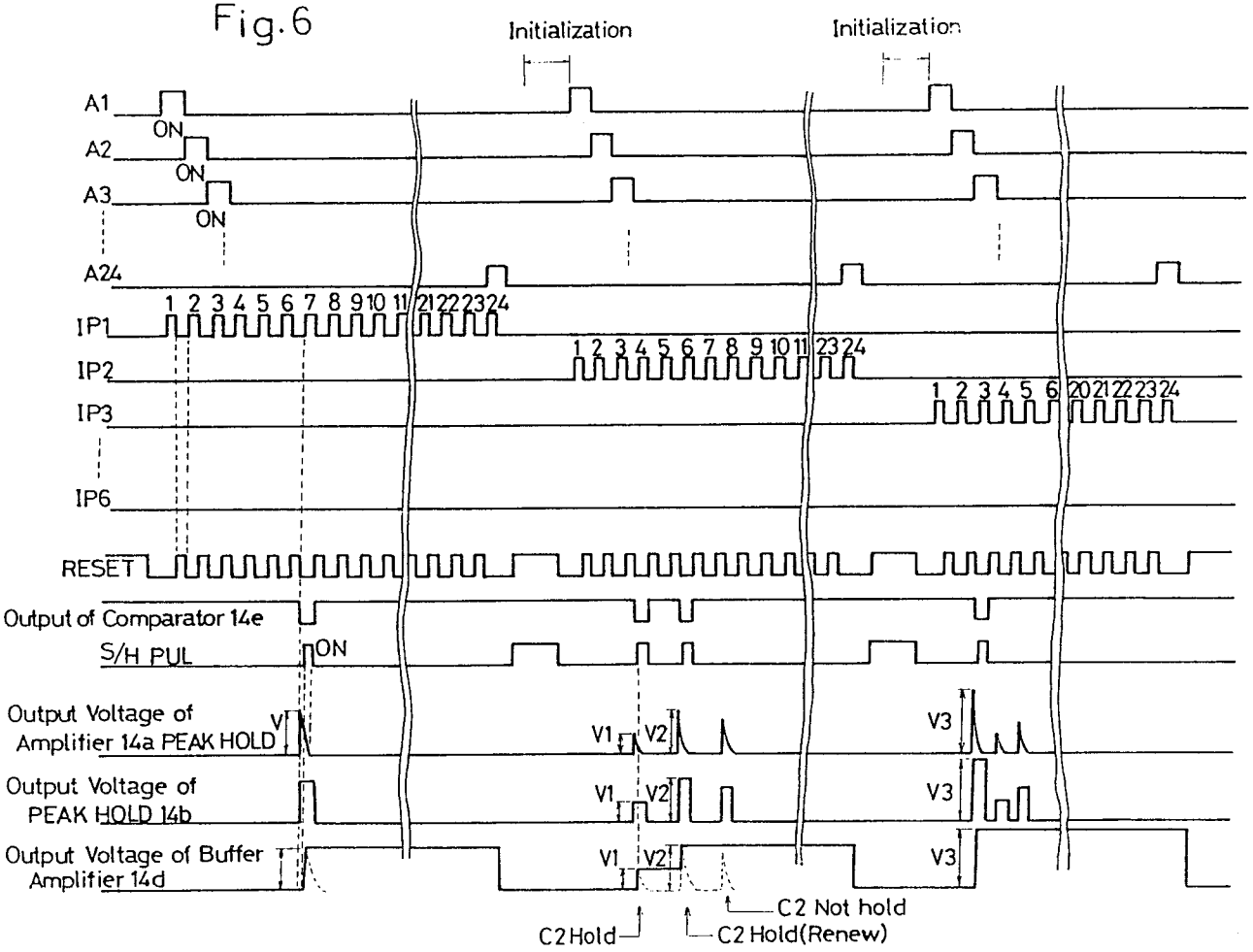
FIG. 6 is a gragh showing wave shapes produced in each of portions of the circuit in FIG. 5.

Next, the string stop position detecting apparatus 7 of this invention will be described in detail. FIG. 5 shows a chart of a specific circuit for the string stop position detecting apparatus 7 of this invention. FIG. 6 is a graph showing wave shapes of each portion of the said circuit.

The electric current supply to the strings is carried out by controlling the output port from a Low to a High and to a Low by a program of the control CPU and then the output is supplied to the string as an electric current through a buffer amplifier 22. The said program will be described hereinafter. In FIG. 6, an IP 1, an IP 2 and so forth respectively show a pulse of the electric current which is supplied respectively to the first string, the second string and so forth. The electric current supply device 11 is connected to each end of the strings located on the side of the bridge of the guitar. By making the connection of the electric current supply device 11 in the location, it becomes possible to detect the position data of the fret which is most closer to the bridge among the frets contacting the string, as is described in connection with the function hereinbefore. Further, the electric current pulse is used having about 2 mA of wave height and about 2 μsec. of pulse width.

Figure 8:
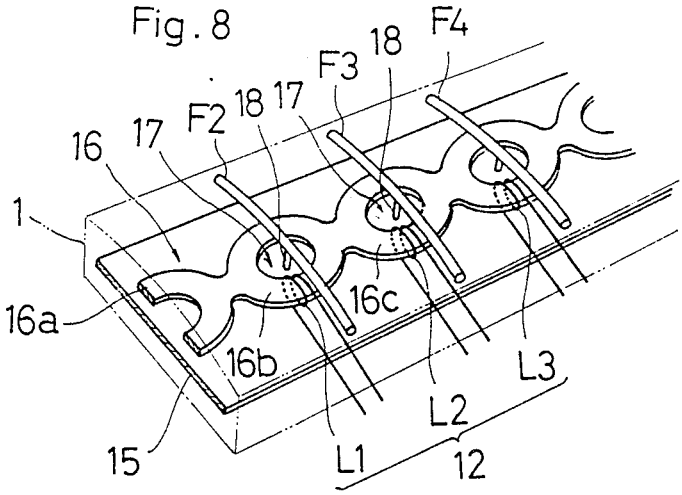
FIG. 8 is a perspective view showing fret detecting device.
Figure 9:
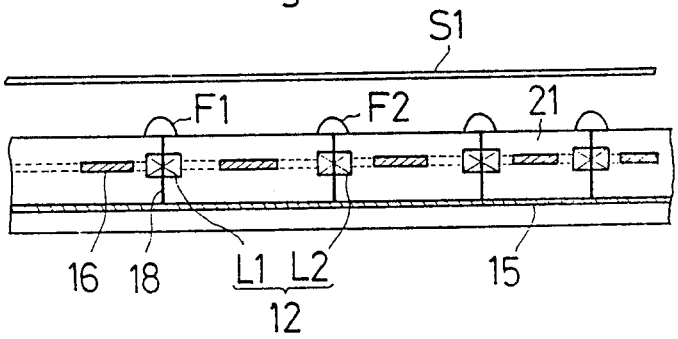
FIG. 9 is a sectional view of the fret detecting device.

As the fret detecting device 12, coils L1–L24 which are connected magnetically to each of the frets F1–F24, are used in this invention. The magnetic connecting structure of the coils L1–L24 is shown in detail in FIGS. 8 and 9. Namely, an earth plate 15 is embeded in the neck 1 of the guitar. A core unit 16 having a plurality of ring-like cores 16*a*, 16*b* and so forth in series, is interposed between the earth plate 15 and the frets F1–F24. Each of the frets F1–F24 and the earth plate 15 are connected to one another by means of lead wires 18*a*, 18*b* and so forth which are disposed to penetrate the center openings 17 of the ring-like cores 16*a*, 16*b* and so forth. The ring-like cores 16*a*, 16*b* and so forth are wound by the coils L1–L24 several times, respectively. The core unit 16 is formed by striking out a plate having a width of 3.2 mm. In this embodiment, the center openings 17 of the core unit 16 have an inner diameter of 4.5 mm and an outer diameter of 8.6 mm, respectively. Further, each of the cores 16*a*, 16*b*may be constructed and so forth independently of each other instead of in the core unit 16.

Figure 10:
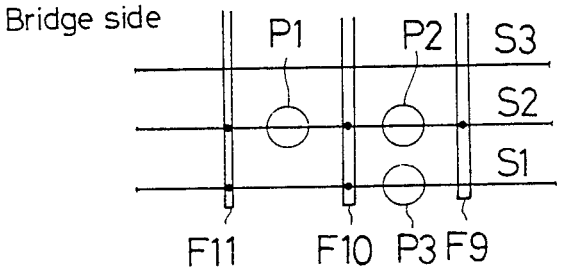
FIG. 10 is a plan view showing a state in which the strings are contacted with the frets.

As shown by a mark O in FIG. 10, suppose that a first string S1 is stopped at a tenth fret P1 and a second string S2 is stopped at a tenth fret P2 and an eleventh fret P3 as well. As to the second string, since a plurality of the frets are in contact with the string at P2 and P3, an induced voltage is generated by each of coils which are disposed correspondingly to the plural frets.

According to the above fret detecting device, when the string is stopped and the string contacts the fret, the electric current pulse flows from the electric current supply device 11 to the string, the fret, the lead wire 18 and the earth plate 15. At the moment, since the ring-like cores 16*a*, 16*b* and so forth of high magnetic permiability are arranged in such a state to cross the lead wires 18, most of the lines of the magnetic force generated by the electric current flowing through the lead wires 18, goes through the ring-like cores which cross the lines of the magnetic force. As the result, in the coil wound around the ring-like cores, a certain voltage is induced in proprortion to the coefficient of variation of the electric current pulse.

The fret multiplexer 13 comprises, for instance, three analog multiplexer 13*a*, 13*b* and 13*c* of eight channels, as shown in FIG. 5. As the analog multiplexer 13*a*, 13*b* and 13*c*, it is utilized a CD4051 which is put in commerce. The control signal of 3 bits is input to the fret multiplexer 13 from the control CPU 9. Each of the analog switches A1, A2 . . . and A24 are changed by the said control signal in synchronism with the electric current pulse of the electric current supply device, as shown by A1–A24 in FIG. 6. Therefore, when the analog switch Ak of k-th is conducted, the coil Lk disoposed at the fret Fk of k-th is connected to the maximum value detecting circuit 14. If the string is in contact with the fret Fk wihle the analog switch Ak is conducted, the coil Lk generates the induced voltage and then the induced voltage is input ot the maximum value detecting circuit 14.

In this embodiment, the maximum value detecting circuit 14 comprises an amplifier 14*a* for amplifying the induced voltage of the coil by predetermined times, a peak-hold circuit 14*b*, a buffer amplifier 14*c* and a comparator 14*e*. Each of the circuits is mainly composed of an ope-amplifier respectivly. Both of an Ao0 and an Ao1 are analog switches. A CD4016 is, for example, used as the analog switches Ao0 and Ao1. The function of the maximum value detecting circuit 14 is as follows: First, when the induced voltage of the coil initially apperars at the output terminal of the fret multiplexer 13, the induced voltage is amplified by the amplifier 14*a* and then input to the peak-hold circuit 14*b* so as to hold the peak voltage in a condenser C1.

The induced voltage is then input to the terminal of plus of the comparator 14*e* through a buffer amplifier 14*c*. When the voltage is higher than that charged to a terminal of minus of the comparator 14*e*, the output of the comparator 14*e* is turned, but is not turned when the voltage is lower than that of the terminal of minus. When the output of the comparator 14*e* is turned, the control CPU transmits a control signal (S/HPUL) to the analog switch Ao1 to drive same and hold the peak-hold voltage in a condensor C2 at the moment. After completion of the step, the control CPU 9 outputs a reset signal and resets the hold voltage of the condenser C1.

Next, when the induced voltage appears again at the output terminal of the multiplexer 13, this voltage is also held at peak and charged to the terminal of pulse of the comparator 14*e* in the same manner as mentioned above. Now, if the second induced voltage is lower than the first induced voltage, the output of the comparator 14*e* is not turned and the analog switch Ao1 is not conducted. Therefore, the condenser C2 still holds the first induced voltage. On the other hand, if the second induced voltage is higher than the first induced voltage, the output of the comparator 14*e* is turned and then the analog switch Ao1 is conducted so that the hold voltage of the condenser C2 may be converted to the second induced voltage. Where the above-mentioned operation is carried out while all of the frets F1–F24 are scanned, the voltage finally held in the condenser C2 is the maximum voltage among a plurality of the induced voltages.

In FIG. 5, 20 denotes each of coupling condensers which cut a derect curent portion of the induced voltage of the coils L1–L24. 21 indicates each of transistors and 22 shows each of buffer drivers, respectively.

The detecting operation of the above-mentioned maximum voltage are shown in detail by the wave shapes in FIG. 6. FIG. 6 shows operation for detecting the maximum voltage with respect to the first to third strings in order. As will be understood from the output wave shapes of the amplifier 14*a* in the drawing, the first string contacts only the seventh fret and the second string contacts the fourth fret, the sixth fret and the eighth fret. The third string contacts the third fret, the fourth fret and fifth fret. Regarding the first string, since it contacts only one fret as mentioned above, the induced voltage V generated at the seventh fret becomes the maximum voltage. Therefore, the output voltage of the buffer amplifier 14*d* is kept at the voltage V until the multiplexer 13 finishes scanning of the 24th fret from a time of scanning the seventh fret. Regarding the second string, the induced voltage is generated at three frets contacting this string. However, as will be seen from the output voltage of the peak-hold 14*b* in FIG. 6, since the induced voltage V2 of the sixth fret is the highest, the output voltage of the buffer amplifier 14*d* is converted from V1 to V2 when the multiplexer 13 scans the sixth fret and thereafter the voltage value V2 is kept until scanning of the 24th fret is completed. As to the third string, though the induced voltage is generated at the three frets contacting this string, as seen from the output voltage of the peak-hold 14*b*, the induced voltage of the third fret is the highest and therefore the output voltage of the buffer amplifier 14*d* is kept at the maximum voltage V3 until the muletplexer 13 completes scanning of the 24th fret from a time of scanning the third fret.

Figure 7:
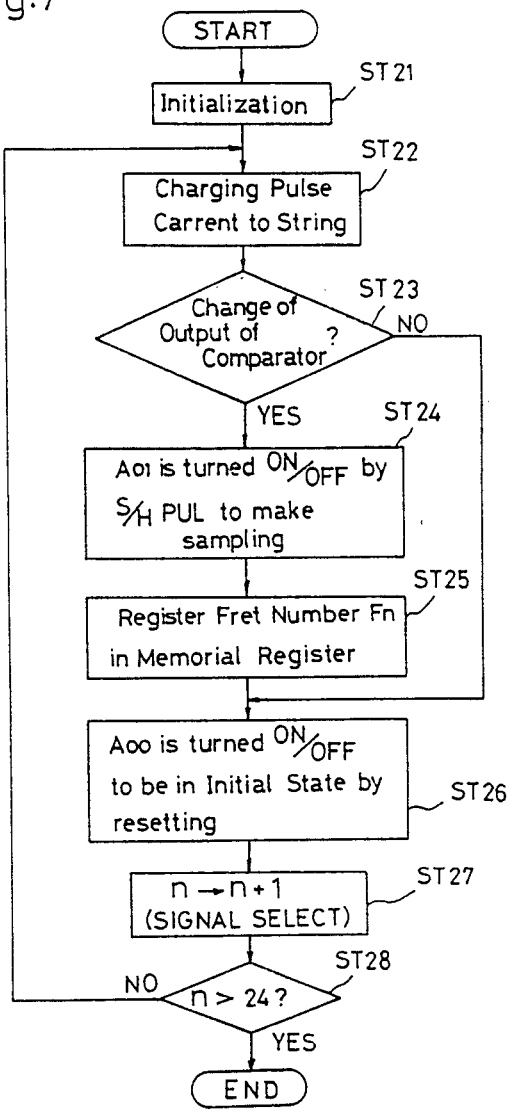
FIG. 7 is a flow chart for explaining the function of calculating or finding out the fret where the highest induced voltage is generaged.

Thus, detection of the maximum voltage is carried out with respect to each of the strings. In parallel with this detection, it is calculated to find out the fret number at which the maximum voltage is produced. This function is shown by a flow chart of FIG. 7.

In the flow chart, when n is designated to be 1 in an initial setting of a step ST-21 and the analog switches Ao0 and Ao1 are turned off and further the fret number (Fk) memorized in a memorial register of the control CPU, is reset. After the initial setting, it proceeds to a step ST-22 and a unit of a pulse current is flown to the string which is detected to find out the fret. Continuously, it proceeds to a step ST-23 so as to judge whether or not there occurs a change in the output of the comparator 14*e*. In this case, since it is designated to be n=1 in the initial setting, the coil output of the first fret is connected to the maximum value detecting circuit 13 by means of the multiplexer 13. Therefore, if the first string is in contact with the first fret, the output of the comparator 14*e* changes. However, if the first string does not contact the first fret, the output of the comparator 14*e* never changes. When the output of the comparator changes, it proceeds to a step ST-24 so as to turn on or off the analog switch Ao1 and sample the peak-hold voltage in the condenser C2 and then register the fret number F1 in the memorial register in a step ST-25. After resistering, it proceeds to a step ST-26 so as to turn on or off the analog switch Ao0 and reset the voltage held in the condenser C1. Thereafter, it proceeds to a step ST-27 and n is added by one (n=2).

On the other hand, when the output of the comparator 14*e* does not change in a step ST-23, it proceeds derectly to the step ST-27 from a step ST-23 via a step ST-26 and then n is added by one (n=2).

When n is designated to be 2 in the step ST-27, it proceeds to a step ST-22 via a step ST-28 and a second unit of the pulse current is flown to the string. Further, changing of the output of the comparator 14*e* is checked and if there is a change in the output, the maximum voltage held in the condenser C2 is renewed in the step ST-24 and then the fret number F2 designated by the equation n=2 is registered in the memorial register. On the other hand, when there is no change in the output of the comparator 14*e*, it proceeds from the step ST-23 to the steps ST-26 and 27.

Whenever it proceeds to the step ST-27, n is added by one and the maximum voltage is renewed when there is a change in the output of the comparator 14*e*, and then the new fret number Fn is registered in the memorial register. On the other hand, when there is no change in the output of the comparator 14*e*, n is increased by one without changing the voltage and the fret number. When the equation becomes n=25, fret detecting operation is ended. When the fret detecting operation is ended in this manner, the fret number Fn registered in the memorial register is the fret which generates the maximum voltages, i.e. the fret stopped by a finger via the string.

According to the apparatus of this invention, it becomes possible to detect the fret contacting the string by utilizing the differential value of the electric current flowing through the fret since the fret detecting device comprises coils which are connected magnetically to the frets. Therefore, the apparatus does not work erroneously due to degrees of the registance value of the strings or the contacting resistance between the strings and the frets, and then becomes possible to detect the string stop position or positions with high precision. Further, since it detects the differential value of the electric current, it is not necessary to use a high tension current as the current flowing through the strings, as in the prior art. Therefore, it is possible to use such parts of small current capacity which are low in price and make its manufacturing cos down.

This invention may be modified within the scope thereof.

I claim:

1. An apparatus for detecting at least one stop position in string instruments having at least one tightened string and a plurality of frets for detecting a sound pitch comprising:

electric current supply means for supplying an electric current to at least one string;

each of said plurality of frets being connected to ground;

coil means for surrounding the electric current path from the string and through the fret to ground; and detecting means operatively coupled with said coil means for detecting the stopped position of the string in response to the voltage generated in the coil means from electric current flowing through a corresponding fret to ground when said corresponding fret and the string contact one another.

2. The apparatus as claimed in claim 1 wherein said and detecting means includes a core unit having a plurality of ring-like cores in series, and lead wires disposed to penetrate the center openings of the ring-like cores and connected to the frets, the coil being wound around the ring-like cores respectively.

3. An apparatus as claimed in claim 1 wherein the electric current supply means supplies a pulse current having sharp rises and falls.

4. An apparatus as claimed in claim 1 wherein the electric current supply means supplies a current flowing from a bridge toward a nut.

* * * * *